United States Patent [19]

Gardner

[11] 4,148,396

[45] Apr. 10, 1979

[54] CUSHIONING INSERT

[75] Inventor: Jeffrey M. Gardner, Wheaton, Ill.

[73] Assignee: Container Corporation of America, Chicago, Ill.

[21] Appl. No.: 891,306

[22] Filed: Mar. 29, 1978

[51] Int. Cl.[2] ..... B65D 81/00; B65D 5/20

[52] U.S. Cl. ..... 206/521; 206/424; 229/40; 206/814

[58] Field of Search ..... 206/521, 585, 587, 423, 206/591, 424, 814; 220/445, 461, 416; 229/15, 40

[56] References Cited

U.S. PATENT DOCUMENTS

| | | | |
|---|---|---|---|
| 1,783,570 | 12/1930 | Hill | 206/591 |
| 2,866,585 | 12/1958 | Alexander | 229/15 |
| 3,050,228 | 8/1962 | Lane | 229/15 |
| 3,119,542 | 1/1964 | Pomerantz | 206/585 |
| 3,184,135 | 5/1965 | Johnson | 220/416 |
| 3,248,036 | 4/1966 | Weiss | 229/15 |
| 3,921,891 | 11/1975 | Gorham | 229/15 |

*Primary Examiner*—Herbert F. Ross
*Attorney, Agent, or Firm*—Carpenter & Ostis

[57] ABSTRACT

A double ply, multi-cell cushioning insert for use in the packaging of heavy objects such as books.

1 Claim, 4 Drawing Figures

CUSHIONING INSERT

SUMMARY OF THE INVENTION

This invention relates to the packaging of heavy articles such as books and primarily to a one piece cushioning insert adapted to be interposed between packaged articles and a wall of an outer container to provide protection for the packaged articles.

It is a primary object of the invention to provide a one piece two cell cushioning insert formed of a unitary blank of foldable paperboard.

A more specific object of the invention is the provision of a cushioning insert for heavy articles which includes a pair of cells formed by a plurality of double thickness reinforcing pieces to afford protection for packaged articles.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 3:
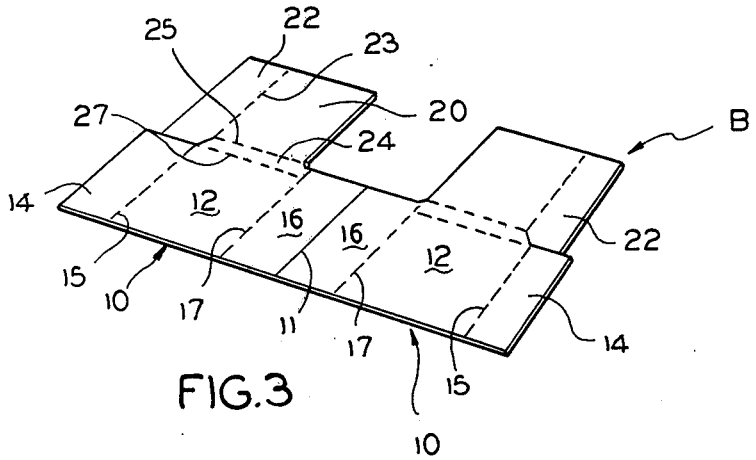
FIG. 3 is a perspective view of a blank of foldable paperboard from which the insert illustrated in the other views may be formed.
Figure 1:
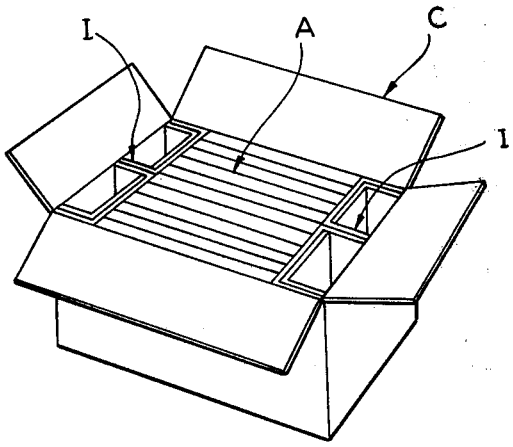
FIG. 1 is a perspective view of an outer container holding packaged articles which are protected from damage by cushioning inserts embodying features of the invention.

Referring now to the drawings for a better understanding of the invention, it will be seen that there is illustrated in FIG. 1 an outer shipping container, indicated generally at C, containing a plurality of heavy articles such as books, indicated generally at A, and also containing a pair of cushioning inserts indicated at I, each of which may be formed from the unitary blank B of foldable paperboard illustrated in FIG. 3.

Figure 2:
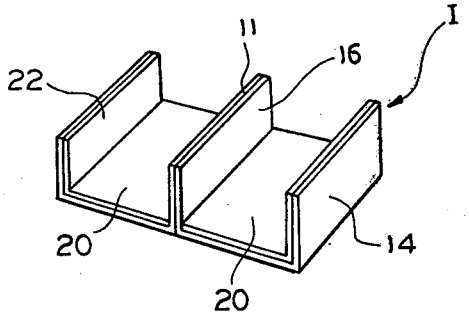
FIG. 2 is a perspective view of one of the inserts illustrated in FIG. 1, as best seen in the completely erected position.
Figure 4:
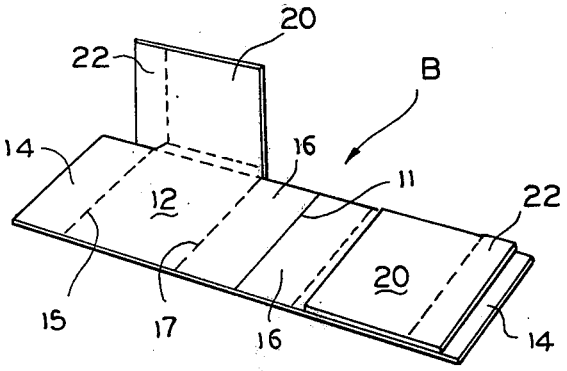
FIG. 4 is a perspective view of the blank illustrated in FIG. 3 but shown in a partially illustrated condition.

As best seen in FIGS. 2 and 3, insert I includes a pair of U-shaped sections 10 which are foldably joined to each other and positioned in side by side relation to form a pair of air cells between the packaged articles and the related end wall of the container.

Each of the insert sections 12 includes an outer center panel 10 having a pair of first and second side panels 14 and 16 foldably joined to opposed side edges thereto along fold lines 15 and 17, respectively.

Each section also includes an inner center panel 20 having a first side panel 22 foldably joined to one side edge thereof along a fold line 23.

Inner center panel 20 is foldably joined to outer center panel 12 by means of a relatively narrow elongated hinge strap 24 which is foldably joined to inner center panel 20 and outer center panel 12 along fold lines 25 and 27, respectively.

In order to form or erect the insert, the inner center panels 20 of each section are folded to lie in face to face relation with the related outer center panels and the side panels are all folded in a direction normal to the center panels so that first side panels 14 and 22 of each section lie in face to face relation, and the second side panels 16 of each section which are foldably joined to each other along fold line 11 are folded against each other in face to face relation. Thus there is provided a structure which is of double thickness throughout its entirety with the second side panels 16 of the respective sections forming a common center support for the insert as best seen in FIG. 2.

Thus it will be appreciated that the invention provides a unique means of developing a one piece double thickness cushioning insert which provides a pair of air cells for cushioning the contents of a package.

I claim:

1. A unitary blank of paperboard, or the like, for forming a cushioning insert for an outer container, said blank comprising:

(a) a pair of main sections foldably joined to one another along a fold line disposed centrally of the blank;

(b) each of said main sections including:

(i) a first center panel, an inner panel and an outer panel;

(ii) said inner and outer panels being foldably joined to the respective opposite side edges of said first center panel;

(iii) a second center panel foldably hinged to said first center panel intermediate said side edges by a hinge strap defined by a pair of parallel hinge lines joining said first and second center panels;

(iv) a flap foldably joined to an edge of said second center panel and abutting said outer panel when folded as said insert but being separated from said outer panel by a cut line;

(c) said fold line defining said main sections and defining a side edge of said inner panel of each of said sections when folded to form said insert.

* * * * *